US006307461B1

(12) United States Patent
Frank et al.

(10) Patent No.: US 6,307,461 B1
(45) Date of Patent: Oct. 23, 2001

(54) SPRING LOAD REDUCTION THERMOSTAT

(75) Inventors: James P. Frank, Rock Falls; Manuel L. Gonzalez, Sterling; Ronald W. Poling, Morrison, all of IL (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/359,105

(22) Filed: Jul. 22, 1999

(51) Int. Cl.[7] ..... H01H 37/28; H01H 35/24

(52) U.S. Cl. ..... 337/305; 337/309; 337/322; 337/323; 200/406; 200/461

(58) Field of Search ..... 337/305, 119, 337/117, 114, 115, 400, 398, 396, 394, 393, 390, 383, 382, 332, 330, 327, 323, 322, 321, 320, 318, 319, 311, 309, 306, 37–41, 51–53; 219/511; 200/406, 407, 448, 460, 461

(56) References Cited

U.S. PATENT DOCUMENTS

| | | | | |
|---|---|---|---|---|
| 2,833,894 | * | 5/1958 | Weber et al. | 337/309 |
| 3,065,320 | * | 11/1962 | Cobean | 337/319 |
| 3,065,323 | * | 6/1962 | Grimshaw | 337/327 |
| 3,569,670 | * | 3/1971 | Eff | 219/413 |
| 3,580,229 | * | 5/1971 | May | 123/41.12 |
| 3,636,490 | * | 1/1972 | Pansing | 337/93 |
| 3,648,012 | * | 3/1972 | Holtkamp | 219/413 |
| 3,648,214 | * | 3/1972 | Slonneger | 337/311 |
| 3,878,498 | * | 4/1975 | Allen et al. | 337/347 |
| 4,163,129 | * | 7/1979 | Rossi et al. | 200/81.4 |
| 4,166,268 | * | 8/1979 | Beck | 337/309 |
| 4,206,344 | * | 6/1980 | Fischer et al. | 219/507 |
| 4,490,708 | | 12/1984 | Thompson et al. . | |
| 4,510,480 | * | 4/1985 | Rossi et al. | 337/321 |
| 4,993,144 | * | 2/1991 | Llewellyn et al. | 29/622 |
| 5,021,762 | * | 6/1991 | Hetrick | 337/103 |
| 5,142,261 | | 8/1992 | Fuller et al. . | |
| 5,191,310 | * | 3/1993 | Obermann et al. | 337/105 |
| 5,585,774 | | 12/1996 | Bennett . | |
| 5,847,636 | * | 12/1998 | Sehlhorst | 337/303 |

* cited by examiner

*Primary Examiner*—Leo P. Picard
*Assistant Examiner*—Anatoly Vortman
(74) *Attorney, Agent, or Firm*—Carl B. Horton, Esq.; Damian Wasserbauer, Esq.; Armstrong Teasdale LLP

(57) ABSTRACT

A temperature responsive switch includes a housing, electrical contacts, an actuator arm, a rotatable shaft, and a cam assembly to open and close an electrical power circuit in response to environmental conditions. The cam assembly includes a cam and a cam follower attached to the actuator arm with a bias spring and contacting a cam surface. The cam surface has a first portion for adjusting the temperature calibration of the switch, and a second portion for positioning the cam follower in an OFF position that reduces the load on the bias spring. Thus, spring losses are avoided when the cam follower is in the OFF position, and the switch may be more accurately calibrated and adjusted when the switch is returned from the OFF position.

16 Claims, 4 Drawing Sheets

SPRING LOAD REDUCTION THERMOSTAT

BACKGROUND OF THE INVENTION

This invention relates generally to condition-responsive switches and, more particularly, to a refrigerator thermostat with a reduced spring load in the off position.

Switches that are responsive to temperature changes, commonly known as thermostats or cold controls, are used in refrigeration appliances, such as refrigerators and freezers, to control the temperatures therein. These thermostats regulate the switching cycle of the refrigeration compressor in response to the temperature of the air contained at some location within the appliance. When the temperature exceeds a certain "turn-on" point, the switch contacts are closed and the compressor is switched on to cool the appliance. When the temperature drops below a certain "turn-off" point, the switch contacts are opened and the compressor is switched off.

One type of thermostat utilizes a bellows communicating with a capillary tube in thermal contact with the location to be cooled. Expansion and contraction of a gas within the capillary tube and bellows causes the length of the bellows to expand and contract. The motion of the bellows moves a pivoting actuator arm to open and close switch contacts to turn the compressor on and off. The actuator arm is biased with a spring to counteract the bellows and calibrate the thermostat so that the compressor will be turned on and off at specified temperatures. The bias of the spring is typically preset at the factory where the switch is manufactured, but is adjustable by a user so that a refrigeration compartment may be kept warmer or cooler as desired.

User adjustment of the set point of such a thermostat is accomplished via rotation of a shaft that extends through a thermostat housing. As the shaft rotates, a cam connected to the shaft also rotates, and a cam follower contacts a surface of the cam to increase or decrease the load on the actuator arm bias spring that connects the cam follower and the actuator arm.

Sometimes, it is desirable to open the switch contacts and prevent the compressor from cycling on and off, such as during storage, cleaning, and defrosting of refrigeration appliances. This is accomplished by shaping the cam surface so that the spring attached to the cam follower is increasingly loaded as the cam follower follows the cam surface to an OFF position. In such a position, the bellows may not generate sufficient force to overcome the spring and close the switch contacts, and by either positioning the actuator arm in a "manual off" position to ensure the separation of the switch contacts, or by opening a secondary pair of contacts known as a "line switch," it can be ensured that the compressor will not be switched on. In a manual off thermostat, the increased cam profile causes the cam follower to push a manual off leg that is connected to the actuator arm. This places the actuator arm in a pivoted position separating the switch contacts. In a line switch thermostat, a cam flag attached to the cam contacts and moves a push rod which separates a secondary pair of contacts and breaks the circuit through the thermostat.

In both manual off and line switch off thermostats, the increased load on the actuator arm bias spring is undesirable. The increased load on the bias spring leads to spring load loss that negatively affects the calibration of the switch when the thermostat is returned from an OFF position to a desired WARM or COLD setting. Thus, the thermostat is rendered inaccurate, the refrigeration compartment runs warmer or colder than desired, and user adjustability of the ON and OFF compressor temperatures is compromised.

Accordingly, it would be desirable to provide a thermostat which reduces or eliminates the bias spring load in an manual OFF or line switch OFF position.

BRIEF SUMMARY OF THE INVENTION

In an exemplary embodiment of the invention, a condition responsive electric switch includes a housing, an actuator arm, a shaft, and a cam assembly. The actuator arm is mounted within the housing for pivotal movement that opens and closes electrical contacts to break or to complete an electrical connection through the switch in response to environmental conditions. By rotating the shaft that partially extends through said housing, the sensitivity of the switch to environmental conditions may be adjusted.

The cam assembly comprises a cam connected to the shaft within the housing, and a spring loaded cam follower connected to the actuator arm. The cam includes a cam surface of first and second portions. The first portion is convex and the second portion is directed inwardly toward the shaft. The cam follower contacts the cam surface and is connected to the actuator arm by a bias spring. The bias spring is preset, or loaded, in a calibrated position at the factory to resist movement of the actuator arm until specified temperatures are reached in a refrigerator compartment. When the cam follower contacts the first portion of the cam surface, the preset calibration load on the spring can be adjusted by rotating the shaft, and hence the cam.

As the shaft is rotated to an OFF position, the cam follower contacts the second portion of the cam surface. Because the second portion of the cam surface is inwardly directed toward the shaft, the cam follower moves toward the shaft and the adjustable load on the spring is relieved. The shaft continues to rotate until the cam follower encounters an actual stop. The cam assembly is then in the OFF position and returns the spring to its preset, pre-calibrated position.

Thus, a condition responsive electric switch is provided that reduces the stress on the spring attached to the cam follower when the switch is in the OFF position.

DETAILED DESCRIPTION OF THE INVENTION

Figure 1:
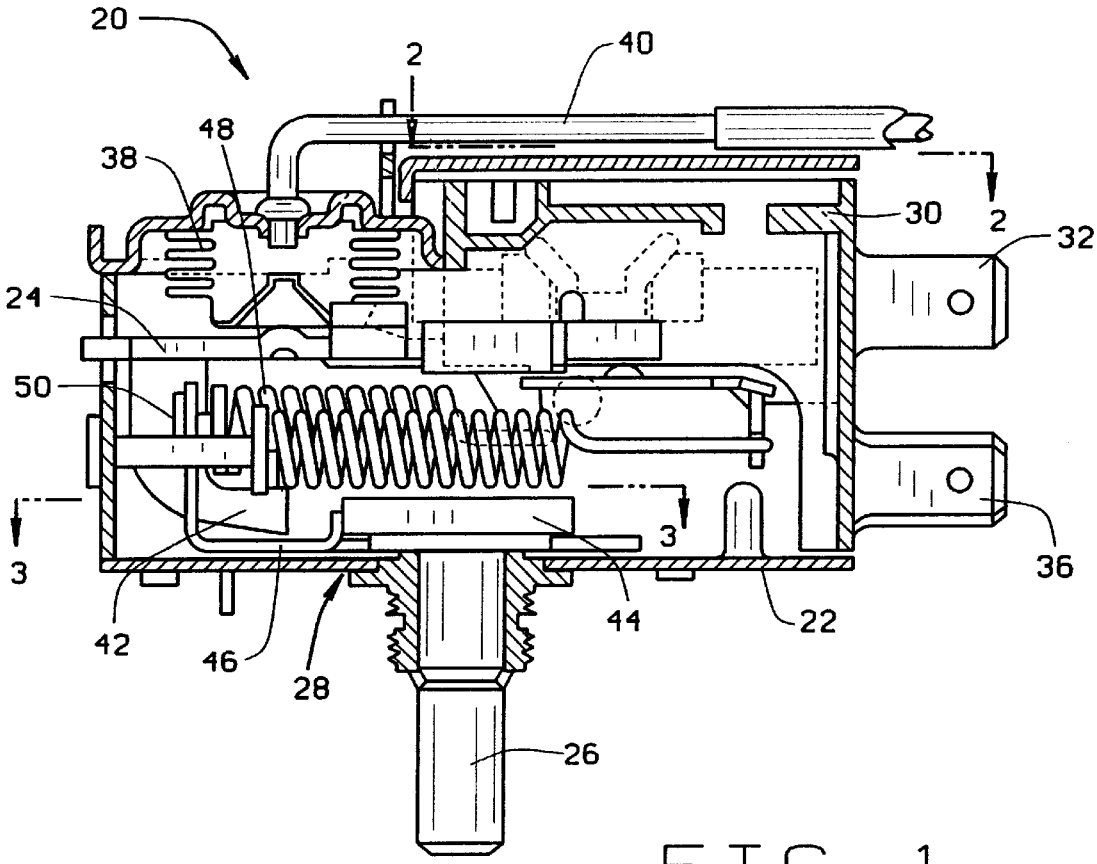
FIG. 1 is a cross-sectional view of a refrigerator thermostat having a manual off switch.

FIG. 1 is a partial cross sectional view of a condition responsive electric switch, or thermostat 20. Thermostat 20 includes a housing 22, electrical contacts (not shown in FIG. 1), an actuator arm 24, a rotatable shaft 26, and a cam assembly 28.

Housing 22 includes an insulated housing portion 30, a first terminal 32, a second terminal (not shown in FIG. 1), and a pair of ground terminals 36 for plug-in connection to an electric circuit such as a power circuit for a compressor (not shown). The power circuit is broken and completed through terminals by the operation of a bistable spring switch (not shown in FIG. 1).

Actuator arm 24 is pivotally mounted withing housing 22 for a rocking movement that manipulates the bistable spring switch to cycle the compressor on and off in response to temperature conditions in a refrigeration compartment (not shown). A bellows 38 and capillary tube 40 are charged with an operating fluid, such as a refrigerant gas, that expands and contracts due to temperature changes in a refrigeration compartment. As the operating fluid expands and contracts, bellows 38 move actuator arm 24, which transmits the movement of bellows 38 to the bistable spring switch to actuate the switch between circuit open and circuit closed positions. Also, because thermostat 20 is of a manual off design, actuator arm 24 includes a manual off leg 42.

Shaft 26 extends partially through housing 22 and is rotatable for adjustment of the temperature conditions that cause actuator arm 24 to cycle the compressor on and off. Shaft 26 has an OFF position, a WARM position, and a COLD position. In the off position, the electrical contacts of the switch are forced apart as described below and the switch is unresponsive to temperature changes in the refrigeration compartment. In an ON position, i.e., not in the OFF position, shaft 26 may be rotated to any desired setting between the WARM position and the COLD position.

Cam assembly 28 includes a cam 44 within housing 22 and connected to shaft 26, and a spring loaded cam follower 46 connected to actuator arm 24. Hence, a primary bias spring 48 connects cam follower 46 to actuator arm 24 and serves both to bias actuator arm 24 against movement and to keep cam follower 46 in contact with cam 44. A screw 50 allows primary bias spring 48 to be calibrated to preset factory specifications during manufacture of thermostat 20 so that actuator arm 24 will pivot appropriately at desired temperature ranges. A secondary spring 60 also biases actuator arm 24 against movement. References to "bias spring" hereinafter shall refer to primary bias spring 48 only and not to spring 60.

Figure 2:
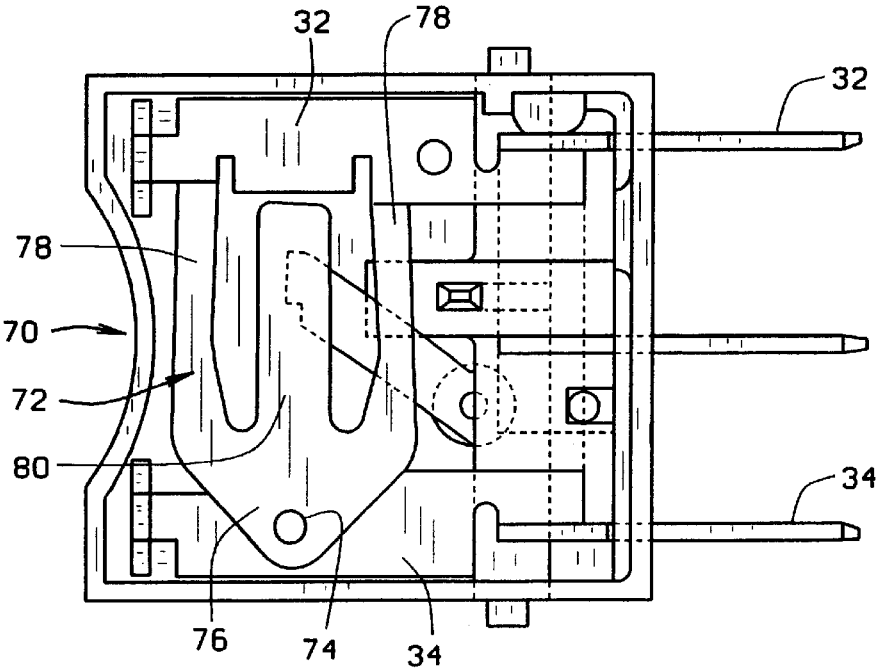
FIG. 2 is a cross-sectional view along line 2—2 of FIG. 1.

FIG. 2 illustrates a bistable spring switch 70 operated by actuator arm 24 (shown in FIG. 1). Bistable spring switch 70 selectively opens and closes an electrical circuit between first terminal 32 and a second terminal 34. A spring switch element 72 is fixedly connected to first terminal 32 and carries a moveable contact 74 that is selectively engageable with a fixed contact (not shown) that is located on second terminal 34.

Spring switch element 72 includes a head 76 on which movable contact 74 is mounted, and a pair of arms 78 extending outwardly from head 76. A tongue 80 extends outwardly from head 78 and is positioned between arms 78. As bellows 38 (shown in FIG. 1) expand and contract, actuator arm 24 (shown in FIG. 1) engages and moves tongue 80 upward and downward. As the temperature rises in the refrigeration compartment, bellows 38 expand and cause actuator arm 24 to push tongue 80 upward so that spring switch element 72 snaps into a convex configuration that engages movable contact 74 and the fixed contact, completing an electrical circuit through first and second terminals 32, 34. As the temperature falls in the refrigeration compartment, tongue 80 is moved downward, and spring element 72 snaps into a concave configuration that separates the contacts and opens the circuit between first and second terminals 32, 34. In an alternative embodiment, the spring switch includes an alarm for indicating a refrigerator compartment temperature above a threshold level.

Figure 3:
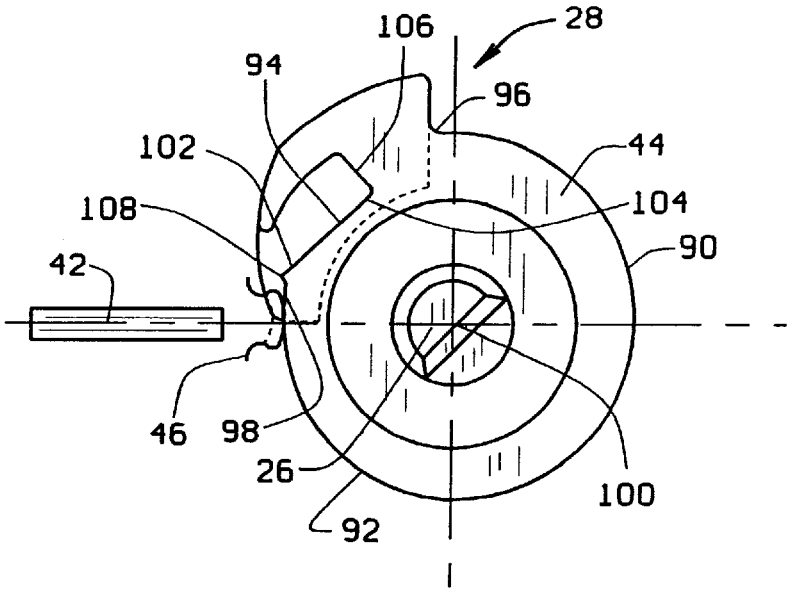
FIG. 3 is a simplified view along line 3—3 of FIG. 1 with parts removed, showing the thermostat in a set position.

FIG. 3 is a simplified plan view of cam assembly 28 in a set position. Cam 44 is attached to shaft 26 and cam follower 46 contacts cam 44. Manual off leg 42 is separated from cam follower 46 so that actuator arm 24 (shown in FIG. 1) may pivot and operate bistable spring switch 70 (shown in FIG. 2) to cycle the compressor on and off.

Cam 44 includes a cam surface 90 including a first portion 92 and a second portion 94. First portion 92 is convexly rounded and has a first end 96 and a second end 98. Measured radially from a center axis 100 of shaft, first end 96 of cam surface first portion 92 is located a greater radial distance from shaft center axis 100 than second end 98 of cam surface first portion 92. Thus, cam surface first portion 92 is spiral-shaped so that the radial separation of first portion from shaft center axis 100 decreases from first end 96 to second end 98. Cam follower 46 contacts cam surface first portion 92 so that, as shaft 26 and cam 44 are rotated, the load on bias spring 48 (FIG. 1) changes and the pre-calibration of bias spring 48 is adjusted. The varying radial cam profile of cam surface first portion 92, together with bias spring 48, creates a rotational tactile feel, or varying resistance as shaft 26 and cam 44 are rotated.

Cam surface second portion 94 is substantially flat and includes a first end 102 and a second end 104. Cam surface second portion 94 is directed inwardly toward shaft 26. In other words, first end 102 of the second portion 94 is located a further radial distance from shaft center axis 100 than second end 104. A stop 106 at second end 104 prevents further rotation of shaft 26 and cam 44 when cam follower 46 contacts stop 106. A concave projection, or false stop 108, on cam surface 90 is located between first portion 92 and second portion 94, i.e., adjacent and between second end 98 of first portion 92 and first end 102 of second portion 94. In an alternative embodiment, the cam surface second portion is curved.

Figure 4:
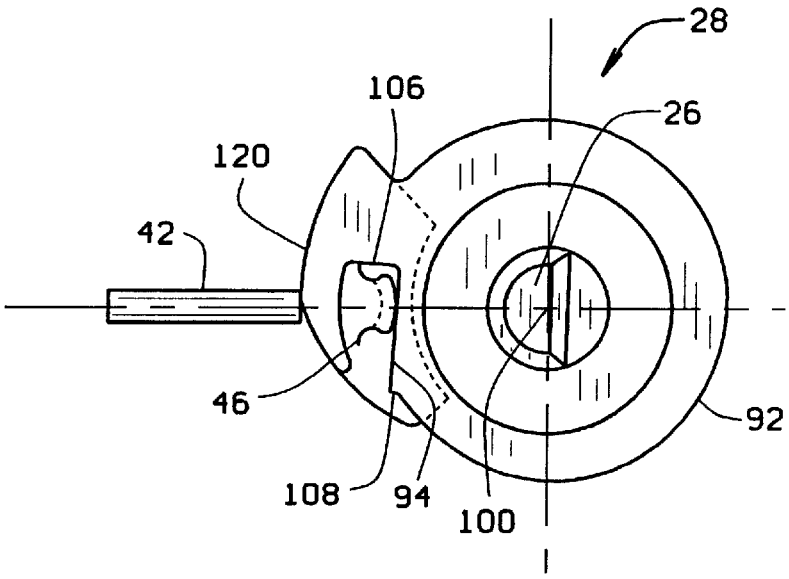
FIG. 4 is a view similar to FIG. 3 but showing the thermostat in a manual off position.

FIG. 4 illustrates cam assembly 44 in an OFF position. As shaft 26 is rotated past the WARM position, cam follower 46 encounters false stop 108 between cam surface first portion 92 and cam surface second portion 94. False stop 108 suddenly increases the load on bias spring 48 (shown in FIG. 1) and prevents a user from inadvertently turning thermostat 20 (shown in FIG. 1) to the OFF position. When additional force is exerted and shaft 26 is rotated past the WARM position, cam follower 46 passes false stop 108 and contacts cam surface second portion 94. Thus, cam follower 46 moves toward shaft 26 along inwardly directed cam surface second portion 94 and the adjustable load on bias spring 48 is relieved. When shaft 26 is rotated until cam follower 46 encounters an actual stop 106 at second portion second end 98, cam assembly 28 is in the OFF position and bias spring 48 is returned to its preset, pre-calibrated position.

Also in the OFF position, a third cam portion 120 contacts manual off leg 42. Third cam portion 120 is convexly rounded and extends a greater radial distance from shaft center axis 100 than either cam surface first portion 92 or second portion 94. Moreover, cam surface third portion 120 is notched so that cam follower 46 may contact cam surface second portion 94 while third portion 120 contacts manual off leg 42 and prevents actuator arm 24 (shown in FIG. 1) from cycling the compressor on and off.

Figure 5:
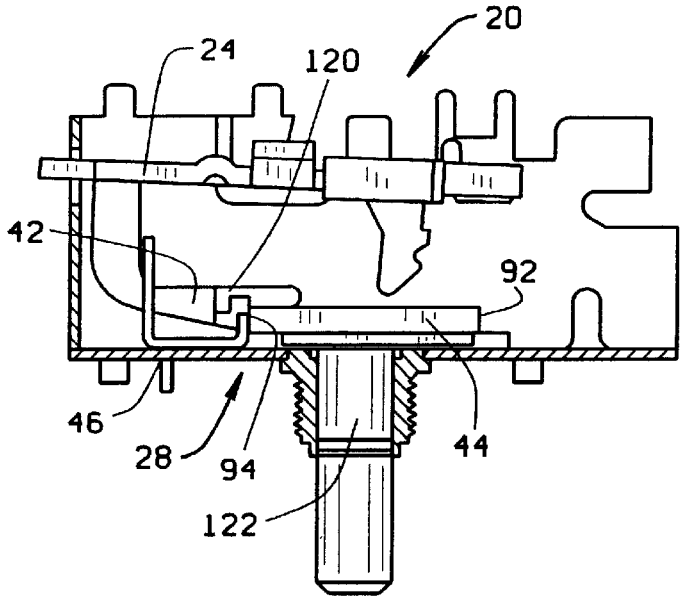
FIG. 5 is a view similar to Figure 1 with parts removed and showing the thermostat in the manual off position.

FIG. 5 is a simplified cross sectional view of thermostat 20 when cam assembly 28 is in the OFF position. Cam surface third portion 120 is attached to cam 44 so that third portion 120 is longitudinally displaced from cam surface first portion 92 and cam surface second portion 94 relative to a longitudinal axis 122 of shaft 26. Therefore, cam follower 46 contacts lower second portion 94 while manual off leg 42 contacts higher third portion 120. Cam follower 46 is accordingly allowed to move toward shaft 26 and relaxes the load on bias spring 48 (shown in FIG. 1), while cam surface third portion 120 contacts manual off leg 42 and causes actuator arm 24 to pivot and open bistable spring switch 70 (shown in FIG. 2). In this position, actuator arm 24 is unresponsive to temperature changes and expansion and contraction of bellows 38 (shown in FIG. 1).

Figure 6:
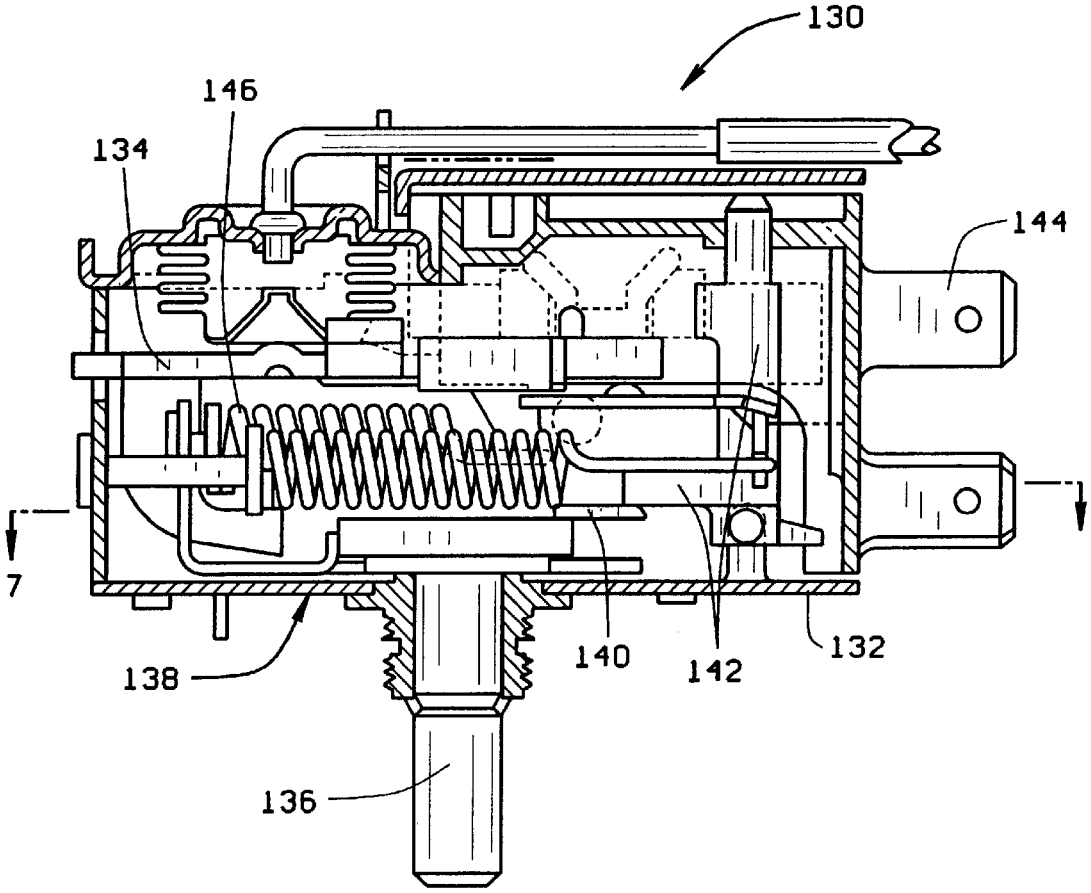
FIG. 6 is a cross-sectional view of a refrigerator thermostat having a line off switch.

FIG. 6 is a partial cross sectional view of a second embodiment of a thermostat 130 including a housing 132, electrical contacts (not shown), an actuator arm 134, a rotatable shaft 136, and a cam assembly 138. Housing 132, the electrical contacts, actuator arm 134, and shaft 136 are constructed and operated substantially as described above with respect to FIGS. 1–5. However, in lieu of a manual off switch according to FIGS. 1–5, thermostat 130 includes a line off switch (not shown) in which a cam flag 140 contacts and moves a push rod 142, thereby opening a secondary set of contacts (not shown) and preventing completion of a circuit through terminals 144 extending from housing 132. Cam assembly 138 relieves the adjustable load on a bias spring 146 when cam assembly 138 is in an off position.

Figure 7:
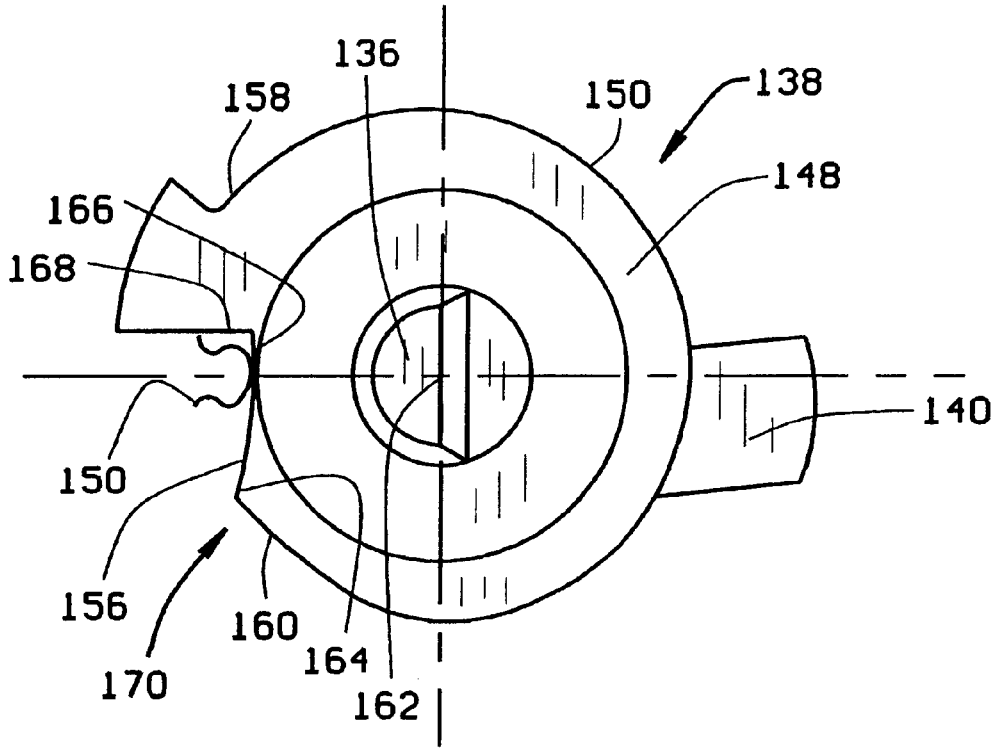
FIG. 7 is a simplified view with parts removed along line 7—7 of FIG. 2, showing the thermostat in a line off position.

FIG. 7 is a simplified plan view of cam assembly 138 including a cam 148 connected to shaft 136 and a cam follower 150. Cam 148 includes a cam surface 150 including a first portion 154 and a second portion 156. First portion 154 is convexly rounded and has a first end 158 and a second end 160. Measured radially from a center axis 162 of shaft 136, first end 158 of cam surface first portion 154 is located a greater radial distance from shaft center axis 162 than second end 160 of cam surface first portion 154. Thus, cam surface first portion 154 is spiral-shaped so that the radial separation of first portion 154 from shaft center axis 162 decreases from first end 158 to second end 160. Cam follower 150 contacts cam surface first portion 154 so that, as shaft 136 and cam 148 are rotated, the load on bias spring 146 (FIG. 6) changes and the pre-calibration of bias spring 146 is adjusted. The varying radial cam profile of cam surface first portion 154, together with bias spring 146, creates a rotational tactile feel, or varying resistance as shaft 136 and cam 148 are rotated.

Cam surface second portion 156 is substantially flat and includes a first end 164 and a second end 166. Cam surface second portion 156 is directed inwardly toward shaft 136. In other words, first end 164 of said second portion 156 is located a further distance from shaft center axis 162 than second end 166. A stop 168 at second end 166 prevents further rotation of shaft 136 and cam 148 when cam follower 148 contacts stop 168. A slight concave projection, or a false stop, 170 on cam surface 152 is located between first portion 154 and second portion 156. In an alternative embodiment, the second portion is curved.

As shaft 136 is rotated past the WARM position, cam follower 150 encounters false stop 170 between cam surface first portion 154 and cam surface second portion 156. False stop 170 suddenly increases the load on bias spring 146 (shown in FIG. 6) and prevents a user from inadvertently turning thermostat 130 off. When additional force is exerted and shaft 136 is rotated past the WARM position, cam follower 150 passes false stop 170 and contacts cam surface second portion 156. Thus, cam follower 150 moves toward shaft 136 along inwardly directed cam surface second portion 156 and the adjustable load on bias spring 146 is relieved. When shaft 136 is rotated until cam follower 150 encounters stop 168 at second portion second end 166, cam assembly 138 is in the OFF position and bias spring 146 is returned to its preset, pre-calibrated position.

Cam 148 also includes a cam flag 140 extending outwardly from cam 148 and beyond cam surface first portion 154 and second portion 156. In the OFF position, cam flag 140 contacts and moves a push rod 142 (shown in FIG. 6) that opens a secondary set of contacts (not shown) and prevents the compressor from cycling on and off.

Figure 8:
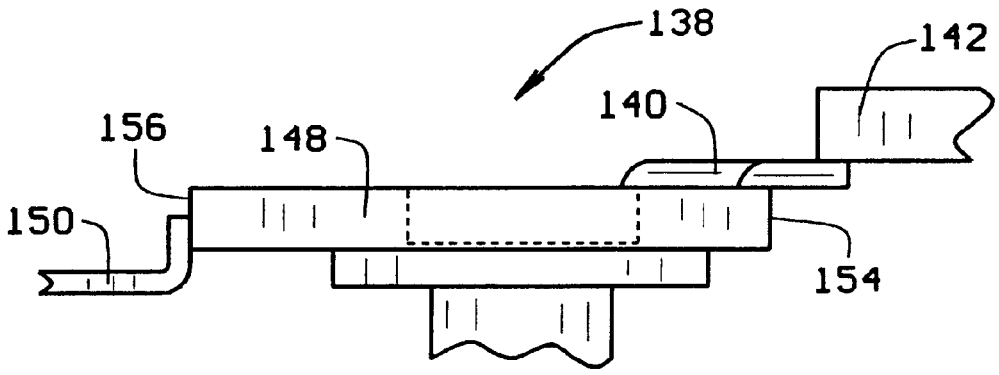
FIG. 8 is a side elevational view of FIG. 7.

FIG. 8 is a simplified side elevational view of cam assembly 138 in the OFF position. Cam follower 150 contacts cam surface second portion 156 so that the load on bias spring 146 (shown in FIG. 6) is reduced. Cam flag 140 is attached to cam 148 and overhangs cam surface first portion 154. Cam flag 140 engages an extension of push rod 142 and lifts push rod 142 to open the line switch and prevent the compressor from cycling on and off.

Thus, because the above embodiments reduce the stress on the spring attached to the cam follower when the thermostat is in the OFF position, spring losses from increased spring loads in the OFF position are avoided, and the switch calibration may be more accurate when the thermostat is returned from the OFF position to a previously calibrated WARM or COLD setting.

While the invention has been described in terms of various specific embodiments, those skilled in the art will recognize that the invention can be practiced with modification within the spirit and scope of the claims.

What is claimed is:

1. A condition responsive electric switch comprising:

a housing;

a first electrical contact and a second electrical contact within the housing, at least one of said first and second contacts moveable between an open position breaking an electrical circuit and a closed position completing an electrical circuit in response to environmental conditions outside said housing;

an actuator arm pivotally mounted within said housing for moving at least one of said first electrical contact and said second electrical contact;

a rotatable shaft partially extending through said housing, said shaft comprising a center axis;

a cam within said housing and connected to said shaft, said cam comprising a cam surface comprising a first portion, a second portion, and a third portion, said cam surface first portion comprises a first end and a second end, said first end positioned a greater radial distance from said center axis than said second end, said cam surface second portion comprises a first end and a second end, said first end positioned a greater radial distance from said center axis than said second end, said cam surface third portion longitudinally displaced from said cam surface first portion and second portion relative to said shaft center axis, said cam surface third portion positioned a greater radial distance from said center axis than said first end of said second portion;

a cam follower contacting said cam surface, said cam follower moveable in response to said cam surface as said cam and said shaft are rotated; and a spring connected to said cam follower and to said actuator arm, said spring including a preset calibration position corresponding to a preset calibration load and an adjustable calibration position corresponding to an adjustable load from rotation of said shaft and said cam when said cam follower contacts said cam surface first portion, said spring connected to said actuator arm such that said spring is returned to said preset calibration position when said cam follower contacts said second portion.

2. A condition responsive electric switch in accordance with claim 1 wherein said cam surface third portion comprises a notch, said cam follower in said notch when said cam follower contacts said second portion of said cam surface.

3. A condition responsive electric switch in accordance with claim 2 further comprising a manual off leg attached to said actuator arm, said cam surface third portion contacting said manual off leg when said cam follower is positioned in said notch.

4. A condition responsive electric switch in accordance with claim 1 wherein said cam surface first portion is rounded, and said cam surface second portion is substantially flat.

5. A condition responsive electric switch in accordance with claim 4 wherein said cam surface further comprises a false stop adjacent said first portion and said second portion.

6. A condition responsive electric switch in accordance with claim 5 further comprising a moveable push rod and line switch, said cam further comprising a cam flag, said cam flag extending outwardly from said cam and beyond said cam surface first portion and said cam surface second portion, said cam flag moving said push rod to open said line switch when said cam follower contacts said cam surface second portion.

7. A condition responsive electric switch in accordance with claim 5 wherein said second end of said first portion is located a greater radial distance from said center axis than said second end of said second portion.

8. A cam assembly for a condition responsive electric switch including an actuator arm for moving an electrical contact to open and close an electrical connection in response to environmental conditions external to said switch, and a shaft for adjustment of the conditions which cause the actuator arm to open and close the electrical connection, said cam assembly comprising:

a cam attached to the shaft, said cam comprising a cam surface comprising a convex first portion, a second portion inwardly directed toward the shaft; and a third portion, said cam surface third portion separated from said first portion and said second portion, said cam surface third portion longitudinally displaced from said cam surface first portion and said cam surface second portion relative to a shaft center axis; and a spring loaded cam follower attached to the actuator arm and contacting said cam surface.

9. A cam assembly in accordance with claim 8 wherein said cam follower includes a preset calibration position and an adjustable calibration position when said cam follower contacts said first portion of said cam surface.

10. A cam assembly in accordance with claim 9 wherein said cam follower returns to said preset calibration position as said cam is rotated so that said cam follower contacts said cam surface second portion.

11. A cam assembly in accordance with claim 10 wherein said cam further comprises a cam flag, said cam flag extending outwardly from said cam and beyond said cam surface first portion and said cam surface second portion.

12. A cam assembly in accordance with claim 11 wherein said cam flag radially extends beyond said cam surface first portion and said cam surface second portion.

13. A cam assembly in accordance with claim 8 wherein said cam surface third portion extends radially beyond said cam surface first portion and said cam surface second portion.

14. A cam assembly in accordance with claim 13 wherein the shaft includes a longitudinal axis, said third portion displaced from said first portion and said second portion along the longitudinal axis.

15. A cam assembly in accordance with claim 8 wherein said cam surface further comprises a false stop between said cam surface first portion and said cam surface second portion.

16. A cam assembly in accordance with claim 8 wherein said third portion comprises a notch separating said third portion from said second portion.

* * * * *

UNITED STATES PATENT AND TRADEMARK OFFICE

CERTIFICATE OF CORRECTION

PATENT NO. : 6,307,461 B1
DATED : October 23, 2001
INVENTOR(S) : James P. Frank et al.

It is certified that error appears in the above-identified patent and that said Letters Patent is hereby corrected as shown below:

Column 7,
Line 33, delete "5" and insert therefor -- 1 --.

Signed and Sealed this

Twenty-eighth Day of October, 2003

JAMES E. ROGAN
*Director of the United States Patent and Trademark Office*